United States Patent [19]

Loos et al.

[11] Patent Number: 4,484,733

[45] Date of Patent: Nov. 27, 1984

[54] PROGRAMMABLE PACKAGING GRID INCLUDING GRIPPER CONVEYOR MONITORING SYSTEM

[75] Inventors: Jerold C. Loos; James R. Wakefield, both of Rocky River; Frederick S. Foster, Avon Lake, all of Ohio

[73] Assignee: Hall Systems, Inc., Westlake, Ohio

[21] Appl. No.: 365,566

[22] Filed: Apr. 5, 1982

[51] Int. Cl.[3] ..... B65H 39/02

[52] U.S. Cl. ..... 270/54; 270/58; 53/131; 53/411

[58] Field of Search ..... 270/54–58; 53/411, 501, 131, 392, 52, 55

[56] References Cited

U.S. PATENT DOCUMENTS

| | | | |
|---|---|---|---|
| 3,608,888 | 9/1971 | McCain | 270/54 |
| 3,819,173 | 6/1974 | Anderson | 270/54 |
| 3,891,492 | 6/1975 | Watson | 270/54 |
| 3,966,186 | 6/1976 | Helm | 270/58 |
| 3,972,521 | 8/1976 | Reed | 270/58 |
| 4,022,455 | 5/1977 | Newsome et al. . | |
| 4,115,981 | 9/1978 | Hell et al. | 53/131 |
| 4,121,818 | 10/1978 | Riley et al. | 270/54 |
| 4,167,476 | 9/1979 | Jackson | 270/58 |
| 4,168,828 | 9/1979 | McLear | 270/54 |
| 4,174,829 | 11/1979 | McCain | 270/58 |
| 4,395,031 | 7/1983 | Gruber et al. | 270/54 |

FOREIGN PATENT DOCUMENTS

| | | | |
|---|---|---|---|
| 967668 | 5/1975 | Canada | 270/54 |
| 2351011 | 1/1978 | France | 53/411 |
| 164243 | 7/1980 | Netherlands | 53/131 |
| 2089328 | 6/1982 | United Kingdom | 270/58 |
| 623756 | 9/1978 | U.S.S.R. | 270/54 |

*Primary Examiner*—E. H. Eickholt

*Attorney, Agent, or Firm*—Fay & Sharpe

[57] ABSTRACT

The programmable packaging grid groups selective ones of a plurality of available printed products, newspapers, and the like based on demographic information concerning the consumer to receive each package. A plurality of longitudinally receiving conveyors (10) each define a series of package receiving areas. A receiving conveyor monitoring means (180) monitors the position of the package receiving areas. A plurality of gripping conveyors (20) which include a plurality of individual grippers run in loops above and transverse to the receiving conveyors. A gripping conveyor monitoring means (182) monitors the position of the individual grippers. A newspaper feeding station (82, 86) feeds newspapers to the belt conveyors to be included in the packages of customers who are also newspaper subscribers. A digital computer (200–286) controls the individual grippers of the gripping conveyors to release selected printed products to fall into selected package receiving areas. The computer is operatively connected with the receiving conveyor monitor and the gripper conveyor monitor to determine coincidence between selected package receiving areas and individual grippers. The digital computer includes a customer memory which stores demographic information about the customer at each address (202) and an advertiser/product memory (204) which is loaded with demographic descriptions of each customer who is to receive each printed product. A customer to advertiser matching routine (206) matches the consumer demographic information with the advertiser/product demographic requirements to determine which printed products are to be supplied to each customer. In this manner, the printed products supplied to each customer are individually tailored based on demographic information.

11 Claims, 6 Drawing Figures

PROGRAMMABLE PACKAGING GRID INCLUDING GRIPPER CONVEYOR MONITORING SYSTEM

BACKGROUND OF THE INVENTION

This application pertains to the art of custom high speed packaging. The invention finds particular application in connection with custom packaging of preprinted advertising products with newspapers and will be described with particular reference thereto. It is to be appreciated, however, that the invention finds broader application in the custom packaging of other advertising materials, distribution materials, telephone books, directories, catalogues, and the like.

Heretofore, various residential and commercial distribution systems have coexisted and provided overlapping services. Commonly, one or more newspapers, telephone directories, advertising fliers, and the like have been distributed in the same geographic area by private distribution systems. Further, mail order catalogues, advertising brochures, sample products, various materials addressed to "resident", and the like are delivered in the same geographic areas by the U.S. Postal Service.

Newspapers and magazines have begun to customize their advertising, inserts, and sections based on geographic region. Commonly, larger newspapers will publish three or four regional additions which are primarily the same, except each includes a regional news section, regional advertising inserts and the like directed toward one region of its distribution area. An apparatus for processing such newspapers is illustrated in U.S. Pat. No. 4,168,828, issued Sept. 25, 1975 to James A. McLear. One or more of the signatures for nationally published magazines is commonly printed with advertising directed toward a specific geographic region. Based on the zip code or other information concerning the subscriber, the appropriate signatures, advertising inserts, subscription renewal post cards, and the like are assembled and bound into the magazine. Typical systems for custom assembling magazines are illustrated in U.S. Pat. No. 4,022,455 issued May 1977 to John Newsome et al., U.S. Pat. No. 3,819,173 issued June 1974 to Frederick Anderson et al. and U.S. Pat. No. 3,608,888 issued September 1971 to McCaine et al.

The prior art regional customizing systems for newspapers and magazines have been limited to fairly large geographic divisions and other broad demographic divisions.

The present invention contemplates an apparatus for producing packages of selected advertising and other printed materials based on individual household demographic information.

SUMMARY OF THE INVENTION

In accordance with the present invention, there is provided a packaging grid for grouping selective ones of a plurality of available printed or other products to produce custom packages. The packaging grid includes a plurality of longitudinally extending receiving conveyors each defining a plurality of package receiving areas. A receiving conveyor monitoring means monitors the position of the receiving conveyors. A plurality of gripping conveyors are disposed above the receiving conveyors. Each gripping conveyor includes a plurality of individual grippers which run in a loop transverse to the receiving conveyors. Each of a plurality of sources of products are disposed adjacent one of the gripping conveyors to supply it with printed products. A gripper conveyor monitoring means monitors the position of the gripper conveyors. A control means controls the gripping conveyors to release selected printed products into selected receiving conveyor package receiving areas. The control means is operatively connected with the receiving conveyor monitor means and the gripper conveyor monitor means to determine coincidence between the positions of the receiving conveyor package receiving areas and the individual grippers such that a printed product is discharged from an individual gripper to a coincident package receiving area.

One advantage of the present invention is that it permits custom packages of printed materials to be assembled for each household in a neighborhood or other delivery region.

Another advantage of the present invention is that it facilitates custom packaging of printed products and other printed materials for insertion into a newspaper. The present invention further facilitates packaging advertising with and without a newspaper such that advertising materials are deliverable to every household in the community whether or not it subscribes to the newspaper.

Another advantage of the present invention is that it readily operates at speeds which are commensurate with the speed of high speed printing process. Further, the invention is capable of operating at higher speeds as faster printing equipment becomes available.

Another advantage of the present invention is that it is adapted to be ceiling mounted to provide efficient use of floor space and facilitate handling of products to be packaged.

Another advantage of the present invention is that it facilitates the delivery of specific advertising materials, fliers, catalogues, and the like throughout a community only to those households which, based on demographics, are most likely to purchase from each advertiser.

Yet another advantage of the present invention is that it is more cost efficient than distribution through the U.S. Postal Service, yet it also provides demographic selection capabilities.

Still further advantages of the present invention will become apparent to those of ordinary skill in the art upon reading and understanding the following detailed description of the preferred embodiment.

BRIEF DESCRIPTION OF THE DRAWINGS

The invention may take form in various parts and arrangements of parts. The drawings are only for the purpose of illustrating a preferred embodiment of the invention and are not to be construed as limiting the invention.

DESCRIPTION OF THE PREFERRED EMBODIMENT

Figure 1:
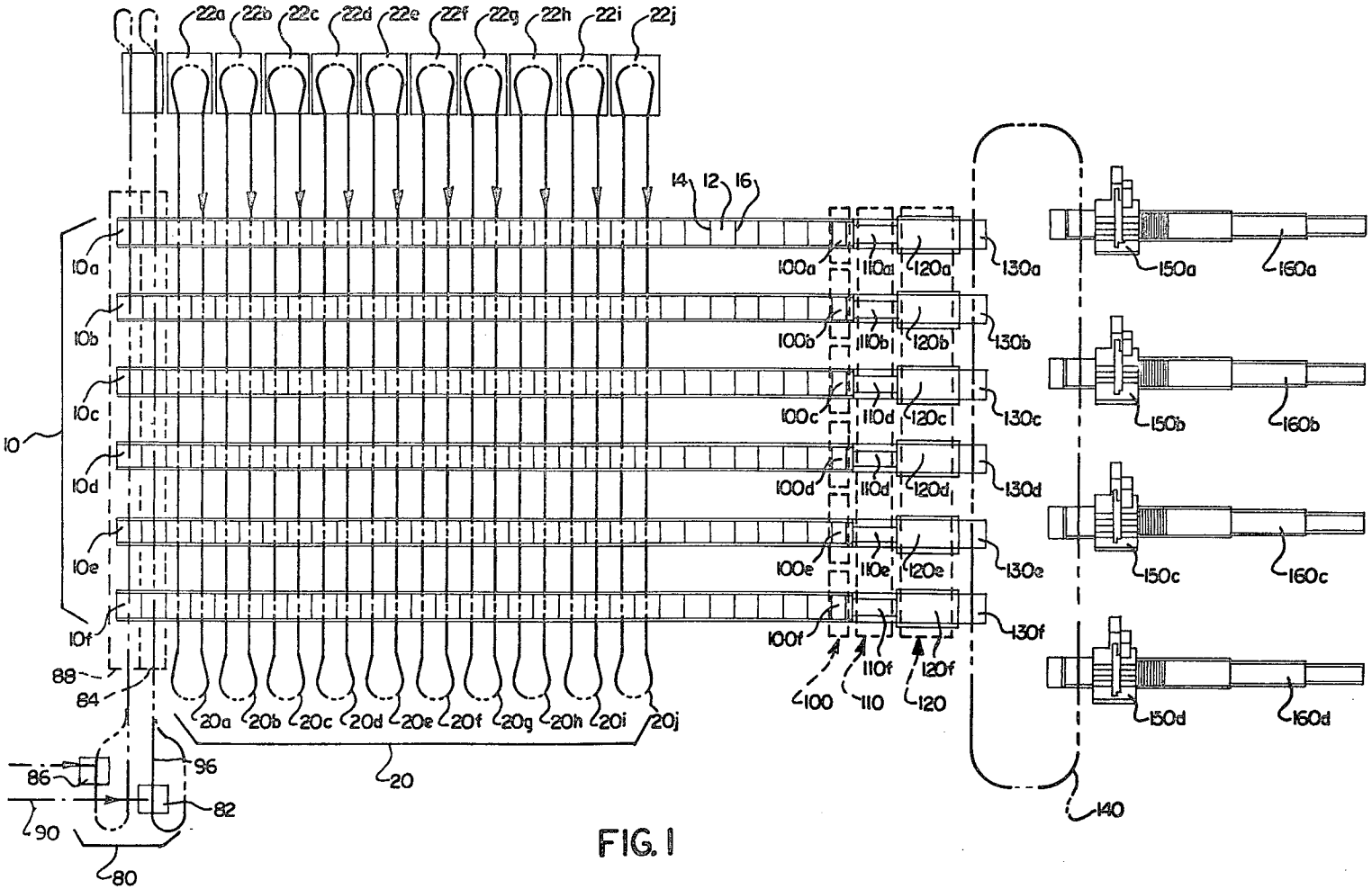
FIG. 1 is a diagrammatic overhead view of a packaging grid system in accordance with the present invention.

With reference to FIG. 1, the packaging grid includes a plurality of belt type receiving conveyors 10 which extend longitudinally. In the illustrated embodiment, six receiving conveyors 10*a*, 10*b*, 10*c*, 10*d*, 10*e* and 10*f* are provided, although it is to be appreciated that the number of receiving conveyors, generalized as N receiving conveyors, may be greater or lesser depending on the desired production capacity and rate. Additional receiving conveyors may be added to accomodate higher speed printing presses at other associated equipment. Each of the receiving conveyors defines a plurality of package receiving areas such as exemplarly package receiving area 12 bounded on either end by verticle partitions 14 and 16.

A plurality of gripping conveyors 20 each having an out and return run are disposed above the receiving conveyors and extend transversely thereacross. The plurality of gripping conveyors includes n gripping conveyors, ten in the illustrated embodiment, 20*a*, 20*b*, 20*c*, 20*d*, 20*e*, 20*f*, 20*g*, 20*h*, 20*i* and 20*j*. A plurality of sources of printed products 22*a*, *l* 22*b*, 22*c*, 22*d*, 22*e*, 22*f*, 22*g*, 22*h*, 22*i*, and 22*j* each supply printed products to at least one of the gripping conveyors. Each of the gripping conveyors includes a plurality of individual grippers which circulate around the two ceiling mounted runs past an associated one of the printed product sources and above the plurality of receiving conveyors for selectively dropping the gripped printed products thereon. The individual grippers in either of the two runs can be actuated to drop a selected printed products into a selected package receiving area. This provides two opportunities for a printed product to be delivered to each package receiving area. The receiving conveyors are elevated to be closely adjacent the ceiling mounted gripper conveyors to minimize the drop distance and to keep the floor space open. Further, the gripping conveyors, in the preferred embodiment, move more rapidly than the belt conveyors, thus causing a plurality of individual grippers in each of the two runs to cross each package receiving area. This further increases the opportunity for supplying each package receiving area with a selected printed product.

Figure 2:
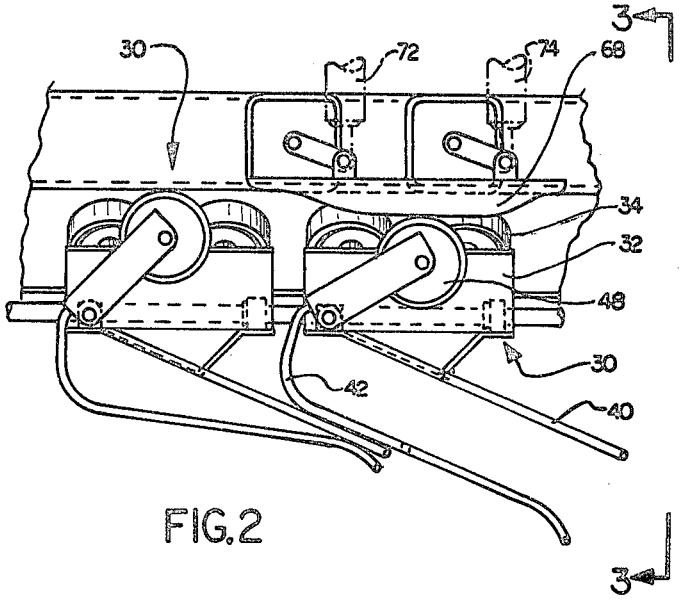
FIG. 2 is a side view for a portion of a gripping conveyor in accordance with the present invention.
Figure 3:
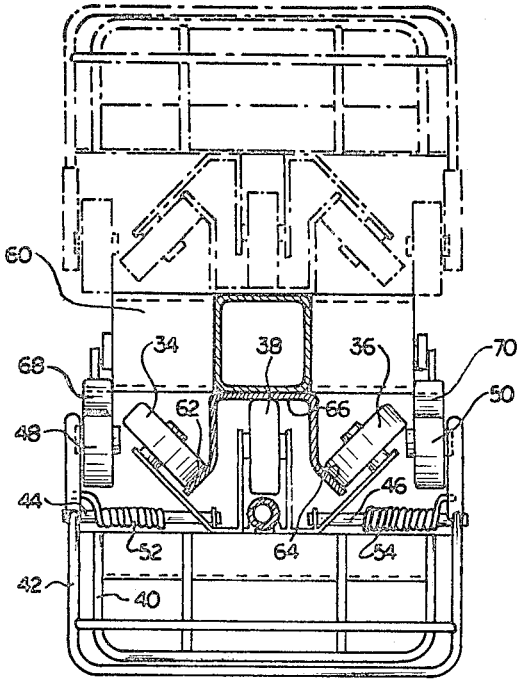
FIG. 3 is a sectional view through section 3—3 of FIG. 2.

With reference to FIGS. 2 and 3, a suitable gripping conveyor includes a plurality of individual grippers 30. Each individual gripper has a body portion 32 on which a plurality of pairs of wheels or rollers 34, 36, and 38 are rotatably mounted. In the preferred embodiment, the three roller pairs are disposed to engage surfaces which are disposed at about 120° relative to each other such that the individual grippers can be maintained stable in a plurality of orientations. Extending outward from the housing portion is a stationary gripping structure 40 which is adapted to be engaged by a moving gripping structure 42. The moving gripping structure is pivotably mounted on a pair of pins 44 and 46. A pair of followers or rollers 48 and 50 are adapted to engage a cam surface to cam the movable gripping member away from the stationary gripping member to release materials gripped therebetween. A biasing means such as a pair of springs 52 and 54 bias the stationary and movable grippers toward the closed position.

The individual grippers are rollingly mounted on a gripper supporting structure. The gripper supporting structure includes a central supporting member 60 on which a U-shaped member having three roller engaging surfaces 62, 64, and 68 is mounted. Because the roller engaging surfaces are mounted at 120 relative to each other, the channel can be twisted about its longitudinal axis up to a full rotation while still supporting the individual grippers. The supporting member 60 also supports a plurality of movable camming surfaces 68 and 70 which selectively engage the cam followers 48 and 50 to open the gripping members 40 and 42. Actuating means such as solenoids 72 and 74 selectively raise and lower the camming surfaces. The camming surface raising and lowering means are disposed at points along the supporting member 60 at which the individual grippers are to be selectively opened and closed. These positions include the crossing points of the out and return runs of the gripper conveyors and each of the receiving conveyors 10 and at the printed product sources 22.

A newspaper feeding means 80 is disposed at the upstream end of the receiving conveyors 10 for feeding a newspaper into each of the package receiving areas of some or all of the receiving conveyors. When advertising packages are to be assembled only for newspaper subscribers, newspapers are supplied to all of the conveyors. When advertising packages are to be supplied to both subscribers and nonsubscribers, the newspapers are supplied to the same proportion of receiving conveyors as the proportion of subscribers to nonsubscribers. The newspaper feeding means includes a first feeding station 82 which receives newspapers from a high speed press and supplies them a feed dividing means 84 which divides the flow of newspapers among the receiving conveyors. A second newspaper feeding station 86 supplies a second flow of newspapers or newspaper sections from a high speed press to a second feed dividing means 88 for dividing the second flow of newspapers among the plurality of belt conveyors. The first and second feeding stations may each supply one or two sections of a common newspaper to each belt conveyor or may supply different newspapers to some of the belt conveyors. For example, one feed station may feed a large regional newspaper and the other feed station may feed a local newspaper, a national specialty paper such as the Wall Street Journal, or the like.

Figure 4:
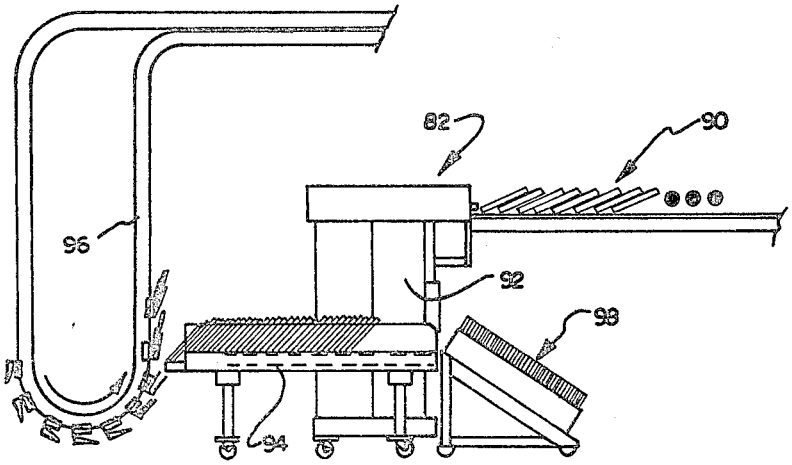
FIG. 4 is a side elevational view of a newspaper feeding station in accordance with the present invention.
Figure 6:
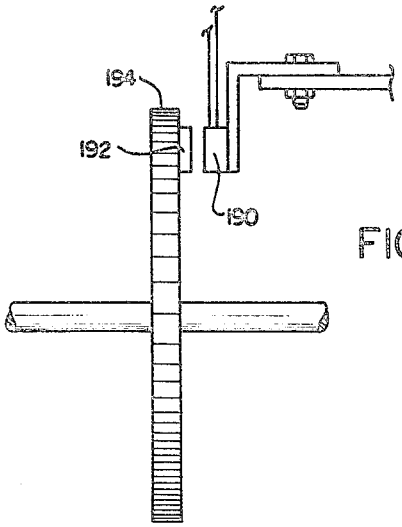

With particular reference to FIG. 4, an exemplary newspaper feeder is illustrated in greater detail. A conveying means 90 conveys lopped newspapers from a high speed press to the newspaper feeder. A conveyor and up-ender 92 moves the newspapers from the conveyor 90 to a transfer table 94. The papers are moved along the transfer table 94 at a speed which is coordinated with a newspaper feeding, gripper conveyor 96, such that one newspaper is provided by the transfer table to each gripping pocket. The newspaper feeding conveyor 96 is a gripping type conveyor having a plurality of individual gripping units of the construction discussed above in conjunction with FIGS. 2 and 3. Gripper releasing means are disposed along the newspaper feed conveyor 96 at its intersection with each of the receiving conveyors for selectively releasing a newspaper into each package receiving area. Although the first and second feed stations 82 and 86 in FIG. 1 are illustrated as receiving separate supplies of newspapers, a single supply of newspapers may be split between a pair of conveyors and up-enders each of which supplies up-ended newspapers to a transfer table, one supplying the first newspaper feeding conveyor and the other supplying a second newspaper feeding conveyor. Optionally, a counter-stacker 98 may be provided to receive newspapers when newspapers are being received from the printing presses faster than they are being conveyed to the belt conveyors 10. Optionally, newspapers may be conveyed from the press to a transfer table with various types of conveyors including the gripping conveyors illustrated in FIGS. 2 and 3.

With reference again to FIG. 1, a plurality 100 of N reject stations 100*a*, 100*b*, 100*c*, 100*d*, 100*e*, and 100*f* are disposed downstream from the gripping conveyors for rejecting incomplete printed product packages. Optionally, the rejected printed product packages may be conveyed to a sorter and returned to the appropriate printed product source.

A wrapping means 110 including a plurality of N wrapping stations 110*a*, 110*b*, 110*c*, 110*d*, 110*e*, and 110*f* are disposed downstream from the reject station. In the preferred embodiment, each of the wrapping station includes a polyethylene or other clear plastic wrapping device for wrapping each package of printed products or printed products and newspaper(s) in a clear waterproof packaging.

A labeling means 120 including a plurality of N labeling machines 120*a*, 120*b*, 120*c*, 120*d*, 120*e*, and 120*f* are also disposed downstream from the reject means 100. The labeling machines label each printed product package with the name and address or other designation of the homeowner or customer for whom the printed products in the package have been collected. The labeling means may be disposed upstream or downstream from the wrapping means such that the labels are applied to the exterior of the wrapper or covered by the clear plastic wrapper for moisture protection. The wrapped and labeled packages are delivered to a plurality 130 of N pick-up stations 130*a*, 130*b*, 130*c*, 130*d*, 130*e*, and 130*f* located downstream from the wrapping and labeling machines.

A sorting conveyor means 140 is disposed downstream from the wrapping and labeling means. The sorting conveyor means includes a plurality of individual grippers, as illustrated in FIGS. 2 and 3, for picking up the wrapped and labeled packages from the pick-up stations 13*a*. The sorting conveyor conveys each package to the appropriate one of a plurality 150 of piling units 150*a*, 150*b*, 150*c*, and 150*d*. Each piling unit ties the packages into route sequenced piles or bundles which are destined for a common route and geographic distribution region. The piles are conveyed from the piling units to a plurality 160 of truck loading means 160*a*, 160*b*, 160*c*, and 160*d* to be loaded directly onto trucks for delivery to the appropriate routes or geographic regions. Optionally, the sorting conveyor means 140 may include a plurality of conveyors to handle the number and rate at which packages become available at the pick up stations 130.

Figure 5:
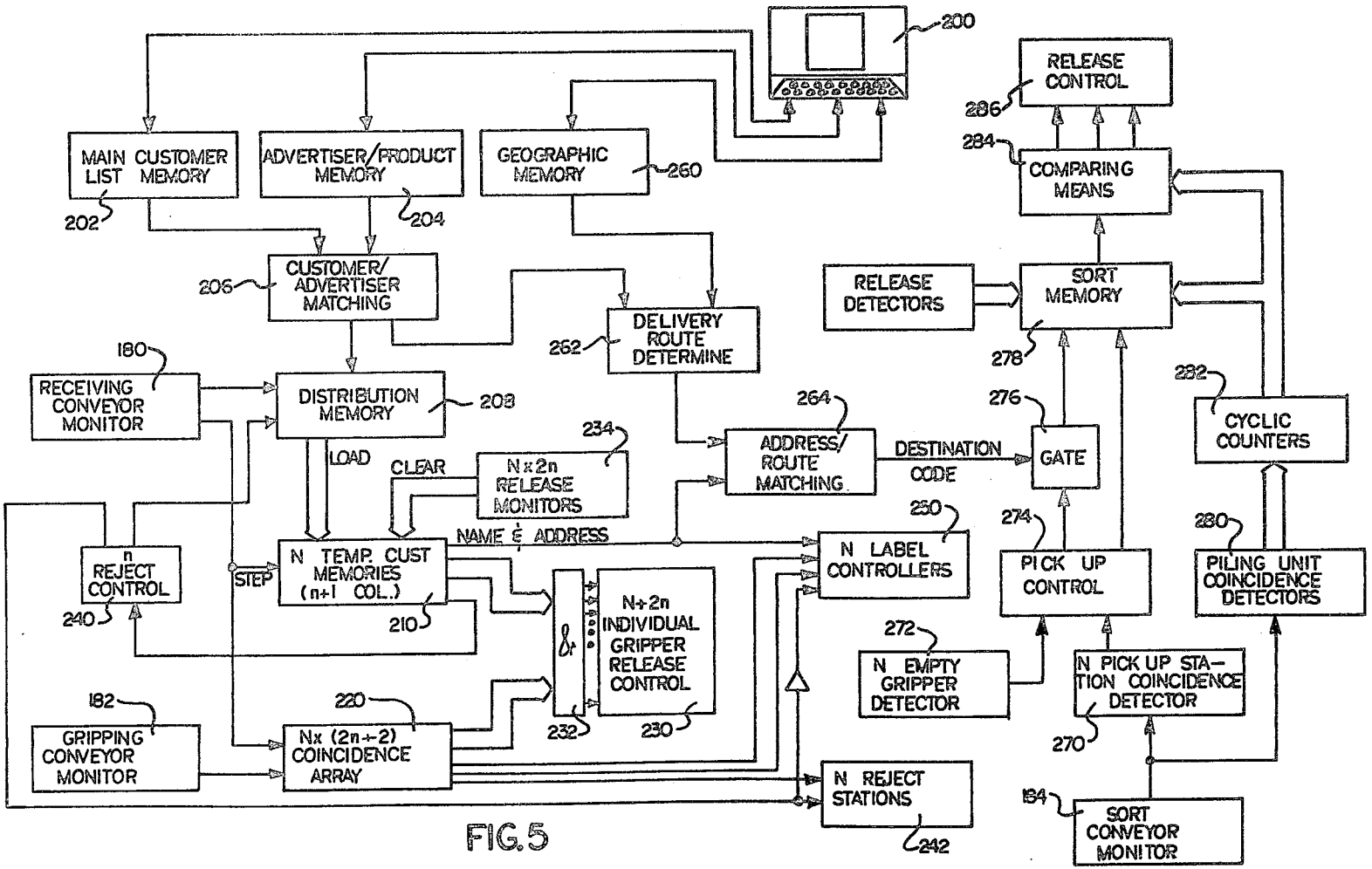
FIG. 5 is a block diagram of the control means for controlling the packaging grid of FIG. 1; and, FIG. 6 is a side view of a conveyor position monitoring means.

With reference to FIG. 5, an electrical control means controls the gripping conveyors, particularly the individual grippers of the gripping conveyors to release selected printed products to fall by gravity into selected receiving conveyor package receiving areas. The control means is connected with a receiving conveyor monitor means 180 for monitoring the position of the receiving conveyors 10. In the preferred embodiment, the receiving conveyor monitor means monitors the position of the package receiving areas by monitoring the speed of the N receiving conveyors. A gripping conveyor monitor means 182 supplies the control means with an indication of the position of each of the n gripping conveyors 20. In the preferred embodiment, the gripping conveying monitoring means monitors the speed of the gripping conveyors. A sort conveyor monitor means 184 monitors the position of the individual grippers of the sorting conveyor means 140 to coordinate the pick up of wrapped and labeled packages at the pick up stations 130 and the delivery of the packages to the piling units 150. A suitable structure for each of the receiving conveyor monitor means, the gripping conveyor monitor means, and the sorting conveyor monitor means includes a reed switch 190 and a moving magnet 192. The magnet is mounted on a wheel 194 which is geared to the associated conveyor to rotate one revolution with the passage of each package receiving area or individual gripper unit. The reed switch is positioned adjacent the wheel to produce a pulse each time a package receiving area or individual gripper unit are in a selected position. Various other well known monitoring devices can be advantageously employed.

The control means includes a data entry and retrieving terminal 200 for entering additional data and information and retrieving stored information. A main customer list memory means 202 stores customer or household information for each customer or household in the service area. In the preferred embodiment, the main customer list memory stores the name and address of each customer in order by address and demographic information in the form of yes or no responses to preselected demographic questions listed in a fixed order. In this manner, only the answers need to stored. The demographic data includes such information as number of children in the household, age of the adults, income range, and the like. An advertisor/product memory means 204 is loaded with demographic information or characteristics of the group of customers to which each printed product is to be directed. That is, a designation of each printed product is stored followed by the answers to the preselected demographic questions which mark the customers to receive the printed product. A customer to advertisor matching program 206 compares the demographic information on each customer from the main customer memory means with the demographic characteristics to which each printed product is directed from the advertiser/product memory means. Based on the customer to advertisor matching, a distribution memory means 208 is loaded with the name and address of each customer or household which is to receive one or more of the printed products and which printed products each customer or household is to receive. In the preferred embodiment, the distribution memory means stores the customer's name and address for controlling the labeling machine and an insert data string including a series of "1"s or "0"s in a preselected order to indicate whether or not each of the printed products is to be given to the customer.

The receiving conveyor monitor 180 is connected with the distribution memory means 208 to index the distribution memory means synchronously with the movement of the package receiving areas to assign one of the customers or households to each package receiving area. Each time the receiving conveyor monitor indexes the distribution memory means, the assigned customer data including the customer name, address, and the insert data string are loaded into a temporary customer memory means 210. In the preferred embodiment, the temporary customer memory means includes N temporary customer memories each of which have n+1 columns. In this manner, each of the temporary customer memories corresponds to one of N receiving conveyors. Each time the corresponding receiving conveyor moves a distance corresponding to the spacing between gripping conveyors, the receiving conveyor monitor means steps the temporary customer memory to shift the stored data by one column and reload the first column with another set of customer information. In this manner, the insert data string in the first column carries customer information concerning the package receiving area which is under or approaching the first gripping conveyor; the customer data in the second column is assigned to the package receiving area approaching the second gripping conveyor, and so forth. The $(n+1)^{st}$ column is reserved for error checking and is discussed in detail below.

A coincidence means 220 is connected with the receiving conveyor monitor means 180 and the gripping conveyor monitor means 182 to determine when an individual gripper on the gripping conveyor is in coincidence with a package receiving area of one of the receiving conveyors. The term "coincidence" designates that the individual gripper and the package receiving area are in appropriate relative positions such that releasing the individual gripper will drop the conveyed printed product into the package receiving area. In the preferred embodiment, the coincidence means 220 includes an array of $N\times(2n+2)$ coincidence detectors or other determining means. Each coincidence means determines coincidence between the package receiving area on one of the receiving conveyors with the individual grippers on the outward and return runs of the n gripping conveyors. The other 2n coincidence detectors detect coincidence between the package receiving area of each of the N receiving conveyors with the N reject means and the N labeling machines.

An individual gripper release control means 230 is connected with the temporary customer memory means 210 and the coincidence means 220 by a series of AND gates 232. More specifically, the individual gripper release control means includes $N\times 2n$ individual gripper release control mechanisms. A first of the individual gripper release control mechanisms is located on a first or upstream run of the first gripper conveyor 20*a* directly over the first receiving conveyor 10*a*; a second of the individual gripper release control mechanisms is located on a second or downstream run of the first gripper conveyor 20*a* directly over the first receiving conveyor 10*a*; and so on for each of the $N\times 2n$ crossing points of the outward and return runs of the gripping conveyors and the receiving conveyors. The first individual gripper release control mechanism is connected by a first AND gate with the temporary customer memory means 210, specifically the first demographic data position of the first column of the first temporary customer memory means, and with the coincidence means, specifically a first coincidence detector for detecting coincidence between the first receiving conveyor 10*a* and the first run of the first gripping conveyor 20*a*. If there is a "1" in the first data position of the first column of the temporary customer memory means, a "1" is supplied to the first AND gate. When an individual gripper on the first gripping conveyor, first run and a first receiving conveyor package receiving area come into coincidence, the first coincidence means also supplies a "1" to the first AND gate. Upon receiving two "1"s the first AND gate causes the first individual gripper release control mechanism to release the carried printed product. A release monitor 234, including an $N\times 2n$ array of monitors, monitors whether or not a printed product was in fact released. If the printed product was released, the release monitor means 234 clears the "1" bit from the corresponding position and column in the temporary customer storage memory means to indicate that the selected printed product has been delivered. If the release monitor fails to detect an actual release of the printed product, the coincidence detector will again produce a "1" when the next individual gripper comes into coincidence causing the individual gripper release control mechanism to release another individual gripper. If none of the grippers in the first run of the first gripping conveyor actually releases a printed product, the coincidence means detects coincidence of the first gripping conveyor second run and first receiving conveyor. When the temporary customer storage memory means and the coincidence means both supply "1"s to a second AND gate which actuates an individual gripper release control mechanism at the crossing point of the first gripping conveyor second run and the first receiving conveyor is actuated. The release of printed products from the outward and return runs of the other gripping conveyors onto the other receiving conveyors is done analogously.

After the customer information data has moved to the $(n+1)^{st}$ column, all the selected printed products should have been released onto the assigned package receiving area. A reject control means 240 adds up the "1"s in the $(n+1)^{st}$ column. If all the selected printed products have been released, the string of printed product data bits should all have been cleared to "0"s by the release monitor means 234. If the sum of these bits is non-zero, the reject control means 240 causes the full set of customer data to be reloaded in the first column of the temporary customer memory means and causes a reject station control means 242 to reject the incomplete package when the coincidence detector array 220 determines that the incomplete package has reached the reject station. If the printed product data in the $(n+1)^{st}$ column sums to zero, the customer name and address portion is conveyed to a corresponding label control means 250 which causes the corresponding labeling machine to print a label with the customers name and address. When the coincidence detector means 220 detects coincidence between the package receiving area and the labeling machine, the label controller 250 causes the labeling machine to apply the label to the corresponding package. In this manner, each package contains the printed products selected specifically for the customer to whom it is labeled and addressed based on demographic information about that customer.

The control means further includes a geographical memory means 260 which stores geographic information on the geographic area over which the packages are to be delivered, such as route information. Alternately, a delivery route determining program 262 may determine the most efficient routes for delivering each specific group of packages based on the specific customers or households which are to receive packages as determined by the customer to advertiser matching means 206 and geographic information from geographic memory means 260. The customer address from the temporary customer memory means 210 and the route information from the geographic memory means 260 or the delivery route determining program 262 are received by an address to route matching program means 264. The address to route matching program 264 compares each customer's street and street number with the street and street numbers assigned to each of the delivery routes and sends out a destination code which indicates which of the delivery routes, hence to which piling unit 150 the completed package is to be delivered. Optionally, the delivery route program can rearrange the customer names in the main customer list memory such that the customer names are retrieved in sequential order within each route.

The sort conveyor monitor means 184 is connected with a pick up station coincidence detector means 270 which detects coincidence between individual grippers on the sorting conveyor 140 and each of the pick up stations 130. An empty gripper means 272 determines whether or not the sort conveyor gripper in coincidence with each pick up station is empty. A pick up command means 274 causes the individual empty gripper which is coincident with the pick up station to pick up the labeled package. Simultaneously with picking up the labeled package, the pick-up command means 274 operates a gate means 276 which causes the destination code from the address to route matching means 264 to be loaded into a memory pixel which is assigned to the specific individual gripper which picked up the labeled package in a sort memory means 278. In this manner, the destination code for each package is stored in the sort memory means in an order corresponding to the order of the individual grippers in the sorting conveyor.

A piling unit coincidence detecting means 280 is connected with the sort conveyor monitor to determine which of the sort conveyor individual grippers is in coincidence with each of the piling units. Each time a new individual gripper comes into coincidence with one of the piling units, a corresponding pointer or cyclic counter means 282 addresses the memory pixel in the sort memory means 278 corresponding to the next individual gripper along the sorting conveyor. A comparing means 284 compares the destination code stored in the memory pixel addressed by the corresponding pointer with the destination code for its associated piling unit. If the comparing means determines that the destination codes match, it operates a corresponding release control means 286 to cause the package to be dropped into that piling unit. If the comparing means determines that the destination codes do not match, the individual gripper continues on and upon becoming coincident with the next piling unit repeats the comparing step. In this manner, the sort memory means 278 circulates the destination code of the package carried in each of the sort conveyor grippers in order. Comparing means for each of the piling units compare the each circulating destination code with the destination code of an associated piling unit to determine when each package is to be released.

In the preferred embodiment, the control means of FIG. 5 is embodied in a digital computer programmed to carry out each of the above-described functions or their equivalents.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment of the invention, we now claim the invention to be:

1. A programmable packaging grid for grouping selective ones of a plurality of available printed products to produce customer insert packages comprising:

a plurality of longitudinally extending receiving conveyors each defining a plurality of package receiving areas;

a receiving conveyor monitor means for monitoring the position of the receiving conveyors;

a plurality of gripping conveyors disposed above the receiving conveyors, each gripping conveyors including a plurality of individual grippers running in a loop generally transverse to the receiving conveyors;

a plurality of sources of printed products, each printed product source disposed adjacent a gripping conveyor to supply printed products thereto;

a gripper conveyor monitor means for monitoring the position of the gripper conveyors;

control means for controlling the gripping conveyors to release selected printed products to fall into selected receiving conveyor package receiving areas, the control means being operatively connected with the receiving conveyor monitor means and the gripper conveyor monitor means for determining coincidence between the receiving conveyor package receiving areas and the individual grippers.

2. The packaging grid as set forth in claim 1 further including newspaper feeding means for feeding a newspaper into each package receiving area of at least some of the receiving conveyors.

3. The packaging grid as set forth in claim 2 wherein the newspaper feeding means includes feed dividing means to divide a flow of newspaper among the plurality of receiving conveyors.

4. The packaging grid as set forth in claim 1 further including a plurality of labeling machines, each labeling machine disposed downstream from the gripping conveyors, operatively associated with one of the receiving conveyors, and operatively associated with the control means for labeling each package of selected printed products with a corresponding label.

5. The packaging grid as set forth in claim 4 further including a plurality of wrapping stations, each wrapping station disposed downstream from the gripping conveyors and operatively connected with one of the receiving conveyors for wrapping the printed product packages conveyed thereon.

6. The packaging grid as set forth in claim 4 further including at least one sorting conveyor for conveying the packages from pick-up stations located downstream from each of the labeling machines to a selected one of a plurality of piling means for bundling a plurality of packages into a bundle.

7. The packaging grid as set forth in claim 6 wherein the sorting conveyor is controlled by the control means such that each piling means receives packages for a selected distribution region.

8. The packaging grid as set forth in claim 7 wherein the control means includes a main customer memory means for storing at least customer addresses and demographic information about each customer such that the demographic information is retrievable for use in controlling the printed products to be packaged for each customer.

9. The packaging grid as set forth in claim 8 wherein the control means includes coincidence determining means for determining coincidence between individual grippers and package receiving areas and includes gripper conveyor release control means for selectively releasing each individual gripper, the gripper conveyor release means being operatively connected with the main customer memory means and the coincidence determining means for releasing a selected printed product in response to both appropriate demographic information and coincidence between an individual gripper conveying the selected printed product and the package receiving area assigned to the corresponding customer.

10. The packaging grid as set forth in claim 4 further including a plurality of reject stations disposed downstream from the gripper conveyors for rejecting packages which fail to receiving all selected printed products, each reject station being operatively connected with one of the receiving conveyors and with the control means.

11. The packaging grid as set forth in claim 4 wherein the control means includes a programmable digital computer.

* * * * *